US009966183B2

(12) United States Patent
Yamauchi et al.

(10) Patent No.: US 9,966,183 B2
(45) Date of Patent: May 8, 2018

(54) MULTILAYER COIL

(71) Applicant: MURATA MANUFACTURING CO., LTD., Kyoto (JP)

(72) Inventors: Kouji Yamauchi, Nagaokakyo (JP); Mitsuru Odahara, Nagaokakyo (JP)

(73) Assignee: MURATA MANUFACTURING CO., LTD., Kyoto-fu (JP)

( * ) Notice: Subject to any disclaimer, the term of this patent is extended or adjusted under 35 U.S.C. 154(b) by 0 days. days.

(21) Appl. No.: 15/000,663

(22) Filed: Jan. 19, 2016

(65) Prior Publication Data

US 2016/0133376 A1 May 12, 2016

Related U.S. Application Data

(63) Continuation of application No. PCT/JP2014/069069, filed on Jul. 17, 2014.

(30) Foreign Application Priority Data

Jul. 29, 2013 (JP) ..... 2013-156447

(51) Int. Cl.
*H01F 5/00* (2006.01)
*H01F 7/06* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
CPC ..... H01F 17/0013; H01F 27/2804; H01F 2027/2809; H01F 41/041; H01F 5/003
(Continued)

(56) References Cited

U.S. PATENT DOCUMENTS 4,543,553 A * 9/1985 Mandai ..... H01F 17/0013 29/602.1
5,392,019 A * 2/1995 Ohkubo ..... H01F 17/0013 333/185

(Continued)

FOREIGN PATENT DOCUMENTS

CN 1241791 A 1/2000
CN 1196146 C 4/2005

(Continued)

OTHER PUBLICATIONS

International Search Report—PCT/JP2014/069069 dated Oct. 14, 2014.

(Continued)

*Primary Examiner* — Alexander Talpalatski
*Assistant Examiner* — Joselito Baisa
(74) *Attorney, Agent, or Firm* — Studebaker & Brackett PC

(57) ABSTRACT

A coil is provided at a multilayer body including insulating layers stacked on one another. The coil includes linear conductors connected by via conductors to make a looped track when viewed from a layer stacking direction. The linear conductors include a first linear conductor contacting with an external electrode provided on the surface of the multilayer body, and a second linear conductor forming a half of the looped track. The first linear conductor includes a coil portion forming a part of the looped track. The second linear conductor is adjacent to the first linear conductor with one of the insulating layers in-between, and a first end of the second linear conductor is connected to a first end of the first linear conductor by a first via conductor. A second end of the second linear conductor does not overlap the first linear conductor when viewed from the layer stacking direction.

9 Claims, 15 Drawing Sheets

(51) Int. Cl.
*H01F 27/28* (2006.01)
*H01F 17/00* (2006.01)
*H01F 27/29* (2006.01)

(52) U.S. Cl.
CPC ..... *H01F 2017/0073* (2013.01); *H01F 2027/2809* (2013.01)

(58) Field of Classification Search
USPC ..... 336/200; 29/602.1
See application file for complete search history.

(56) References Cited

U.S. PATENT DOCUMENTS 5,821,846 A * 10/1998 Leigh ..... H01F 17/0006 336/200
5,986,533 A * 11/1999 Person ..... H01F 17/0013 29/412
6,218,925 B1 4/2001 Iwao
6,238,779 B1 * 5/2001 Iwao ..... B32B 18/00 174/261
6,345,434 B1 * 2/2002 Anbo ..... H01F 17/0013 29/602.1
6,362,716 B1 3/2002 Anbo et al.
6,692,609 B2 * 2/2004 Kobayashi ..... H01F 17/0013 156/272.8
6,820,320 B2 * 11/2004 Anbo ..... H01F 17/0013 29/602.1
6,911,889 B2 * 6/2005 Bodley ..... H01P 1/215 29/602.1
7,652,554 B2 * 1/2010 Moriai ..... H01C 7/1006 338/61
8,749,338 B2 * 6/2014 Takahashi ..... H01F 27/2804 336/200
2002/0083575 A1 * 7/2002 Anbo ..... H01F 17/0013 29/602.1
2004/0233606 A1 * 11/2004 Inoue ..... H01C 1/16 361/118
2009/0160582 A1 * 6/2009 Fukamachi ..... H01P 1/20381 333/204
2013/0147593 A1 * 6/2013 Tachibana ..... H01F 17/0013 336/200

FOREIGN PATENT DOCUMENTS

JP S58-96717 A 6/1983
JP S59-22303 A 2/1984
JP H11-260644 A 9/1999
JP 2005-045103 A 2/2005
JP 2008-053368 A 3/2008
JP 2013-045809 A 3/2013

OTHER PUBLICATIONS

Written Opinion—PCT/JP2014/069069 dated Oct. 14, 2014.
International Preliminary Report on Patentability of the International Searching Authority; PCT/JP2014/069069 dated Feb. 2, 2016.

* cited by examiner 1, 1A~1E

1A

1C

MULTILAYER COIL

CROSS REFERENCE TO RELATED APPLICATIONS

This application claims benefit of priority to Japanese Patent Application 2013-156447 filed Jul. 29, 2013, and to International Patent Application No. PCT/JP2014/069069 filed Jul. 17, 2014, the entire content of which is incorporated herein by reference.

TECHNICAL FIELD

The present disclosure relates to a multilayer coil, and more particularly to a multilayer coil including a linear conductor having a length corresponding to a half of a looped track when viewed from a layer stacking direction.

BACKGROUND

As an example of past disclosures relating to multilayer coils, a coil component disclosed in Japanese Patent Application No. 2013-45809 is known. As illustrated in FIG. 17, a multilayer coil 500 of this kind comprises a multilayer body, linear conductors 501 and straight lead electrodes 511. The multilayer body includes insulating layers stacked on one another. The linear conductors 501 and the straight lead electrodes 511 are provided on the respective insulating layers. The linear conductors 511 have a length corresponding to a half turn. The straight lead electrodes 511 connect the linear conductors 501 to external electrodes (not illustrated in FIG. 17) provided on the surface of the multilayer body.

In the multilayer coil 500, the linear conductors 501 are arranged such that, when viewed from the layer stacking direction, those adjacent to each other with an insulating layer in-between do not overlap each other except for both ends thereof. This is to reduce the floating capacitance generated between the linear conductors 501 adjacent to each other with an insulating layer in-between. In order to arrange the linear conductors 501 such that those adjacent to each other with an insulating layer in-between do not overlap each other when viewed from the layer stacking direction and in order to maximize the number of turns of a linear conductor on one insulating layer, each of the linear conductors 501 has a length corresponding to a half turn. In this way, the Q characteristic of the multilayer coil 500 is improved. In the future, however, electronic components for higher frequency will be demanded, and multilayer coils having a still better Q characteristic will be demanded.

SUMMARY

An object of the present disclosure is to provide a multilayer coil including a linear conductor having a length corresponding to a half of a looped track when viewed from a layer stacking direction and having an excellent Q characteristic.

A multilayer coil according to an embodiment of the present disclosure comprises: a multilayer body including a plurality of insulating layers stacked on one another; a coil provided at the multilayer body and including a plurality of linear conductors connected together by a plurality of via conductors piercing through the insulating layers; and a first external electrode provided on a surface of the multilayer body, wherein: the coil makes a looped track when viewed from a layer stacking direction in which the plurality of insulating layers are stacked; the plurality of linear conductors includes a first linear conductor contacting with the first external electrode, and a second linear conductor forming a part of the looped track when viewed from the layer stacking direction and having a length corresponding to a half turn of the looped track; at least a part of the first linear conductor is a coil portion forming a part of the looped track when viewed from the layer stacking direction; the second linear conductor is adjacent to the first linear conductor with at least one of the insulating layers in-between, and a first end of the second linear conductor is connected to a first end of the first linear conductor by a first via conductor of the plurality of via conductors; and a second end of the second linear conductor adjacent to the first linear conductor with the at least one insulating layer in-between does not overlap the first linear conductor when viewed from the layer stacking direction.

In the multilayer coil according to the embodiment, the first linear conductor includes a coil portion forming a part of the looped track, and one end of the first linear conductor contacts with the external electrode. Thus, the first linear conductor has the same function as the linear conductor 501 of the multilayer coil 500 of the same kind as the multilayer coil disclosed in Japanese Patent Application No. 2013-45809 and also has the same function as the lead portion 511 of the multilayer coil 500. The second end of the second linear conductor, which is adjacent to the first linear conductor with at least one insulating layer in-between, does not overlap the first linear conductor when viewed from the layer stacking direction. Accordingly, the floating capacitance generated between the first linear conductor and the second linear conductor can be reduced. Therefore, the multilayer coil according to the embodiment has an excellent Q characteristic.

EFFECTS OF THE DISCLOSURE

A multilayer coil according to the present disclosure includes a linear conductor having a length corresponding to a half of a looped track and can achieve an excellent Q characteristic.

DETAILED DESCRIPTION

A multilayer coil according to an embodiment and a manufacturing method thereof will hereinafter be described.

Structure of Multilayer Coil; See FIGS. 1-3

The structure of a multilayer coil 1 according to an embodiment will hereinafter be described with reference to the drawings. A direction in which layers of the multilayer coil 1 are stacked on one another will hereinafter be referred to as a z-direction. When the multilayer coil 1 is viewed from the z-direction, a direction in which long sides of the multilayer coil 1 extend will hereinafter be referred to as an x-direction, and a direction in which short sides of the multilayer coil 1 extend will hereinafter be referred to as a y-direction. The x-direction, the y-direction and the z-direction are perpendicular to each other.

The multilayer coil 1 comprises a multilayer body 20, a coil 30, and external electrodes 40*a* and 40*b*. The multilayer coil 1 is, as seen in FIG. 1, substantially in the shape of a rectangular parallelepiped.

Figure 2:
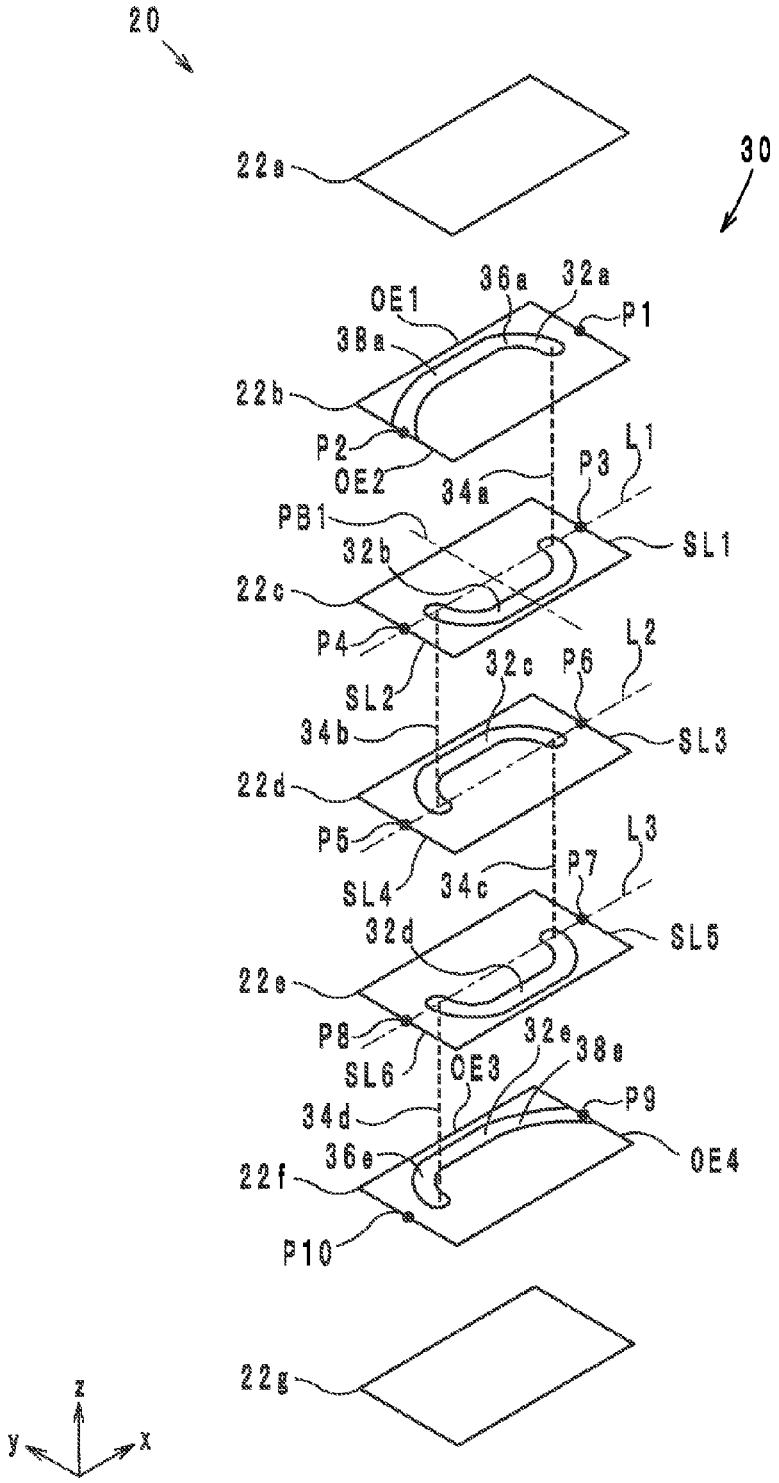
FIG. 2 is an exploded perspective view of the multilayer coil according to the embodiment.

As illustrated in FIG. 2, the multilayer body 20 is formed of insulating layers 22*a*-22*g* stacked in this order from a positive side in the z-direction. Each of the insulating layers 22*a*-22*g* is rectangular when viewed from the z-direction. The surface of the multilayer body 20 on the negative side in the z-direction serves as a mounting surface when the multilayer coil 1 is mounted on a printed circuit board. In the following, the surface of each of the insulating layers 22*a*-22*g* on the positive side in the z-direction will be referred to as an upper surface, and the surface of each of the insulating layers 22*a*-22*g* on the negative side in the z-direction will be referred to as a lower surface. As the material of the insulating layers 22*a*-22*g*, a magnetic material (for example, ferrite, etc.) or a non-magnetic material (for example, a composite material of compositions of ceramic such as a composite material of glass and alumina, etc.) may be used.

Figure 1:
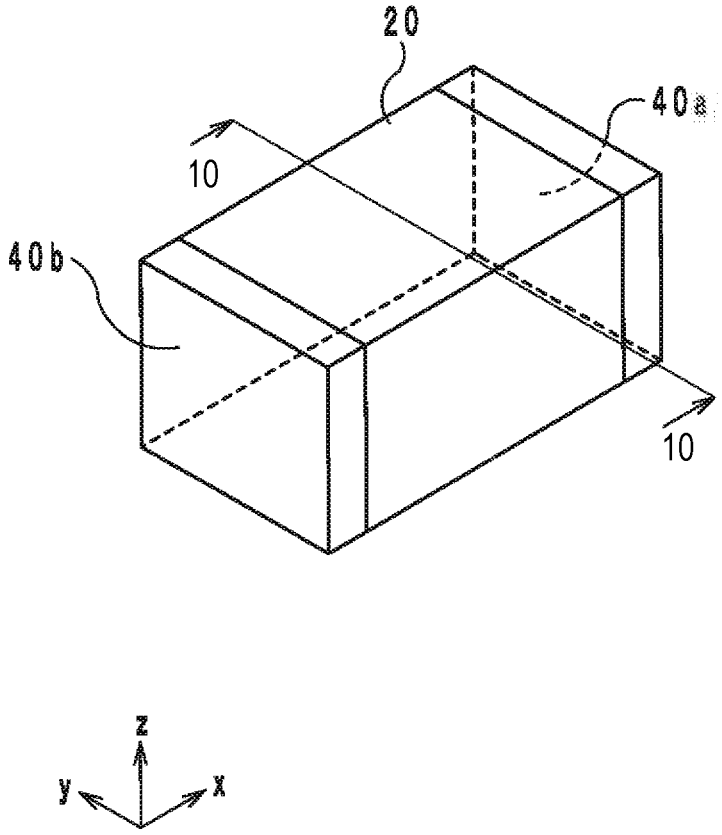
FIG. 1 is a perspective view of a multilayer coil according to an embodiment.

As seen in FIG. 1, the external electrode 40*a* is provided to cover the entire end surface of the multilayer body 20 on a positive side in the x-direction and parts of the surrounding surfaces of the multilayer body 20. The external electrode 40*b* is provided to cover the entire end surface of the multilayer body 20 on a negative side in the x-direction and parts of the surrounding surfaces of the multilayer body 20. The external electrodes 40*a* and 40*b* are made of a conductive material such as Au, Ag, Pd, Cu, Ni, etc.

As seen in FIG. 2, the coil 30 is provided in the multilayer body 20 and is formed of linear conductors 32*a*-32*e* and via conductors 34*a*-34*d*. The coil 30 has a spiral shape proceeding in the layer stacking direction while spiraling, and the axis of spiral is parallel to the z-direction. When viewed from the z-direction, the coil 30 is shaped like an ellipse having a long axis in parallel to the x-direction. The coil 30 is made of a conductive material such as Au, Ag, Pd, Cu, Ni, etc.

In the following, first, the linear conductors 32*b*-32*d* (second linear conductors), which contact with neither of the external electrodes 40*a* and 40*b*, will be described, and next, the linear conductors 32*a* and 32*e* (a first linear conductor and a third linear conductor), which contact with the external electrodes 40*a* and 40*e* respectively, will be described.

The linear conductors 32*b*-32*d* are connected together and makes an elliptical-looped track, as a whole, when viewed from the z-direction.

The linear conductor 32*b* (one of the second linear conductors) is provided on the upper surface of the insulating layer 22*c*. The linear conductor 32*b* is located mainly in a portion of the insulating layer 22*c* on a negative side in the y-direction. When viewed from the z-direction, the linear conductor 32*b* is shaped like a semi-ellipse having a long axis extending in the x-direction and being convexed to the negative side in the y-direction. Thus, the linear conductor 32*b* has a length corresponding to a half of the looped track when viewed from the layer stacking direction. The linear conductor 32*b* contacts with the via conductor 34*a* piercing through the insulating layer 22*b* in the z-direction at one end thereof located near the middle point P3 of a short side SL1 (a part of the outer edge) of the insulating layer 22*c* on a positive side in the x-direction. The linear conductor 32*b* contacts with the via conductor 34*b* piercing through the insulating layer 22*c* in the z-direction at the other end thereof located near the middle point P4 of a short side SL2 (a part of the outer edge) of the insulating layer 22*c* on a negative side in the x-direction. Thus, a straight line L1 passing both ends of the linear conductor 32*b*, which contact with the via conductors 34*a* and 34*b* respectively, crosses the short sides SL1 and SL2 of the insulating layer 22*c* that are parts of the outer edge of the insulating layer 22*c*.

The linear conductor 32*c* (another of the second linear conductors) is provided on the upper surface of the insulating layer 22*d*. The linear conductor 32*c* is located mainly in a portion of the insulating layer 22*d* on a positive side in the y-direction. When viewed from the z-direction, the linear conductor 32*c* is shaped like a semi-ellipse having a long axis extending in the x-direction and being convexed in the positive the y-direction. Thus, the linear conductor 32*c* has a length corresponding to a half of the looped track when viewed from the layer stacking direction. The linear conductor 32*c* contacts with the via conductor 34*b* at one end thereof located near the middle point P5 of a short side SL3 (a part of the outer edge) of the insulating layer 22*d* on the negative side in the x-direction. The linear conductor 32*b* contacts with the via conductor 34*c* piercing through the insulating layer 22*d* in the z-direction at the other end thereof located near the middle point P6 of a short side SL4 (a part of the outer edge) of the insulating layer 22*d* on the positive side in the x-direction. Thus, a straight line L2 passing both ends of the linear conductor 32*b*, which contact with the via conductors 34*b* and 34*c* respectively, crosses the short sides SL3 and SL4 of the insulating layer 22*d* that are parts of the outer edge of the insulating layer 22*d*.

The linear conductor 32*d* (another of the second linear conductors) is provided on the upper surface of the insulating layer 22*e*. The linear conductor 32*d* is located mainly in a portion of the insulating layer 22*e* on the negative side in the y-direction. When viewed from the z-direction, the linear conductor 32*d* is shaped like a semi-ellipse having a long axis extending in the x-direction and being convexed in the negative the y-direction. Thus, the linear conductor 32*d* has a length corresponding to a half of the looped track when viewed from the layer stacking direction. The linear conductor 32*d* contacts with the via conductor 34*c* at one end thereof located near the middle point P7 of a short side SL5 (a part of the outer edge) of the insulating layer 22*e* on the positive side in the x-direction. The linear conductor 32*d* contacts with the via conductor 34*d* piercing through the insulating layer 22*e* in the z-direction at the other end thereof located near the middle point P8 of a short side SL6 (a part of the outer edge) of the insulating layer 22*e* on the negative side in the x-direction. Thus, a straight line L3 passing the both ends of the linear conductor 32*d*, which contact with the via conductors 34*c* and 34*d* respectively, crosses the short sides SL5 and SL6 of the insulating layer 22*e* that are parts of the outer edge of the insulating layer 22*e*.

Figure 3:
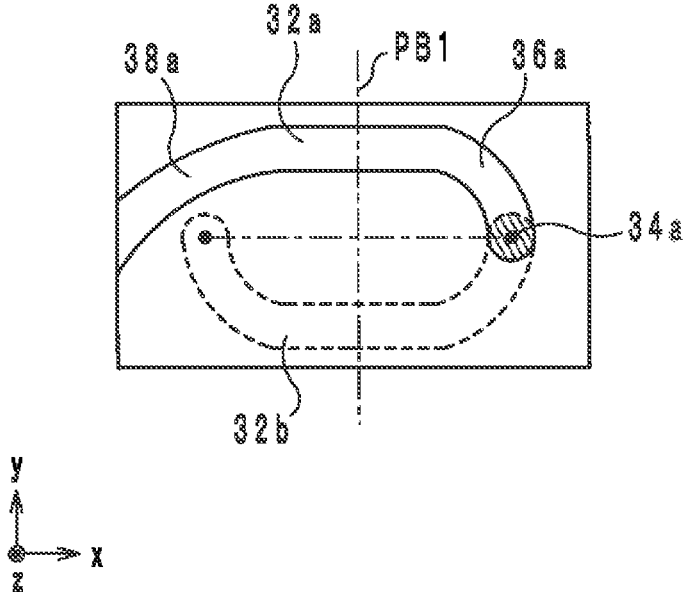
FIG. 3 is a plan view of the multilayer coil according to the embodiment from a layer stacking direction.

The linear conductor 32*a* (first linear conductor) is provided on the upper surface of the insulating layer 22*b*. The linear conductor 32*a* includes a coil portion 36*a* and a lead portion 38*a*. The coil portion 36*a* is located mainly in a portion of the insulating layer 22*b* on the positive side in the x-direction and the positive side in the y-direction. When viewed from the z-direction, the coil portion 36*a* is shaped like a quarter of an ellipse, and the coil portion 36*a* is a part of the looped track. The end of the coil portion 36*a* on the positive side in the x-direction contacts with the via conductor 34*a* near the middle point P1 of the short side of the insulating layer 22*b* on the positive side in the x-direction. The lead portion 38*a* extends from the other end of the coil portion 36*a* (from the end on the negative side in the x-direction) toward the negative side in the x-direction along a part of the outer edge OE1 of the insulating layer 22*b* on the positive side in the y-direction and curves toward the negative side in the y-direction. Then, the lead portion 38*a* is exposed on the surface of the multilayer body 20 through the middle point P2 of a part of the outer edge OE2 (a short side) of the insulating layer 22*b* on the negative side in the x-direction and contacts with the external electrode 40*b*. Thus, the lead portion 38*a* connects the coil portion 36*a* and the external electrode 40*b*. As seen in FIG. 3, when viewed from the z-direction, the perpendicular bisector PB1 of a line segment between both ends of the linear conductor 32*b* is assumed as a border line. Then, when viewed from the z-direction, the end of the coil portion 36*a* on the positive side in the x-direction is located on one side of the border line, and the lead portion 38*a* is led to a part of the outer edge on the opposite side of the border line, that is, led to the part of the outer edge OE2 on the negative side in the x-direction. When viewed from the z-direction, the lead portion 38*a* is outside the looped track.

The linear conductor 32*e* (third linear conductor) is provided on the upper surface of the insulating layer 22*f*. The linear conductor 32*e* includes a coil portion 36*e* and a lead portion 38*e*. The coil portion 36*e* is located mainly in a portion of the insulating layer 22*f* on the negative side in the x-direction and the positive side in the y-direction. When viewed from the z-direction, the coil portion 36*e* is shaped like a quarter of a circle, and the coil portion 36*e* is a part of the looped track. One end of the coil portion 36*e* on the negative side in the x-direction contacts with the via conductor 34*d*. The lead portion 38*e* extends from the other end of the coil portion 36*e* (from the end on the positive side in the x-direction) toward the positive side in the x-direction along a part of the outer edge OE3 of the insulating layer 22*f* on the positive side in the y-direction and curves toward the negative side in the y-direction. Then, the lead portion 38*e* is exposed on the surface of the multilayer body 20 through the middle point P9 of a part of the outer edge OE4 of the insulating layer 22*f* on the positive side in the x-direction and contacts with the external electrode 40*a*. Thus, the lead portion 38*e* connects the coil portion 36*e* and the external electrode 40*a*. When viewed from the z-direction, the lead portion 38*e* is outside the looped track. When viewed from the z-direction, the linear conductor 32*e* is symmetrical to the linear conductor 32*a* with respect to the perpendicular bisector PB1.

In the multilayer coil 1 having the structure above, the linear conductor 32*a* (first linear conductor) is located mainly in a portion of the insulating layer 22*b* on the positive side in the y-direction, whereas the linear conductor 32*b* (second linear conductor) adjacent to the linear conductor 32*a* with the insulating layer 22*b* in-between is located mainly in a portion of the insulating layer 22*c* on the negative side in the y-direction. Also, the lead portion 38*a* of the linear conductor 32*a* is outside the looped track when viewed from the z-direction. Therefore, with regard to the linear conductor 32*b* adjacent to the linear conductor 32*a* with one insulating layer in-between, the end thereof on the negative side in the x-direction does not overlap the linear conductor 32*a* when viewed from the layer stacking direction (see FIG. 3). Likewise, with regard to the linear conductor 32*d* adjacent to the linear conductor 32*e* (third linear conductor) with one insulating layer in-between, the end thereof on the positive side in the x-direction does not overlap the linear conductor 32*e* when viewed from the layer stacking direction.

Manufacturing Method

A manufacturing method of the multilayer coil 1 according to the embodiment will hereinafter be described. In the following, a direction in which green sheets are stacked will be referred to as the z-direction. The direction parallel to the long sides of the multilayer coil 1 manufactured by the manufacturing method will be referred to as the x-direction, and the direction parallel to the short sides of the multilayer coil 1 will be referred to as the y-direction.

First, ceramic green sheets to be used as the insulating layers 22*a*-22*g* are prepared. Specifically, BaO, $Al_2O_3$, $SiO_2$ and other constituents are mixed at a predetermined ratio, and the mixture is wet crushed into slurry. The slurry is calcined at a temperature of 850 to 950 degrees C., and thereby, a calcined powder (a ceramic powder) is obtained. In a similar way, $B_2O_3$, $K_2O$ and $SiO_2$ and other constituents are mixed at a predetermined ratio, and the mixture is wet crushed into slurry. The slurry is calcined at a temperature of 850 to 950 degrees C., and thereby, a calcined powder (a borosilicate glass powder) is obtained.

These calcined powders are mixed at a predetermined ratio, and a binder (for example, vinyl acetate, water soluble acrylic or the like), a plasticizer, a wetter and a disperser are added. These are blended in a ball mill, and the mixture is defoamed by decompression, thereby resulting in ceramic slurry. The ceramic slurry is spread on a carrier film and formed into a sheet by a doctor blade method, and the sheet is dried. In this way, green sheets to be used as the insulating layers 22*a*-22*g* are prepared.

Next, the green sheets to be used as the insulating layers 22*a*-22*g* are irradiated with a laser beam, and thereby, via-holes are formed. The via-holes are filled with a conductive paste consisting mainly of Au, Ag, Pd, Cu, Ni or the like, and the via conductors 34*a*-34*d* are formed. The process of filling the via-holes with a conductive paste may be carried out at the same time as the process of forming the linear conductors 32*a*-32*e*, which will be described later.

After the formation of the via-holes or after the formation of the via conductors 22*b*-22*e*, a conductive paste consisting mainly of Au, Ag, Pd, Cu, Ni or the like is coated on the green sheets to be used as the insulating layers 22*b*-22*e* by screen printing, and thereby, the linear conductors 32*a*-32*e* are formed.

Next, the green sheets to be used as the insulating layers 22*a*-22*g* are stacked in this order and bonded together, and thereby, an unsintered mother multilayer body is obtained. The unsintered mother multilayer body is pressed and fully bonded together, for example, by isostatic pressing.

After the full-scale bonding, the mother multilayer body is cut by a cutter into multilayer bodies 20 having a predetermined size. The unsintered multilayer bodies 20 are subjected to debinding and sintering. The debinding is carried out, for example, in a hypoxic atmosphere at a temperature of 500 degrees C. for two hours. The sintering is carried out, for example, at a temperature of 800 to 900 degrees C. for two hours and a half.

After the sintering, the external electrodes 40*a* and 40*b* are formed. An electrode paste of a conductive material consisting mainly of Ag is coated on the surface of the multilayer body 20. Next, the coated electrode paste is baked at a temperature of about 800 degrees C. for one hour. Thereby, underlayers of the external electrodes 40*a* and 40*b* are formed.

Finally, the surfaces of the underlayers are plated with Ni/Si. Thereby, the external electrodes 40*a* and 40*b* are formed. Through the process above, the multilayer coil 1 is produced.

Effects; See FIGS. 2-6 and 17

In the multilayer coil 1 according to the embodiment above, as seen in FIG. 2, the linear conductor 32*a* includes a coil portion 36*a* serving as a part of the coil 30 and a lead portion 38*a* connecting the coil portion 36*a* and the external electrode 40*b*. Accordingly, the linear conductor 32*a* has the same function as the linear conductor 501 of the multilayer coil 500, which is of the same kind as the multilayer coil disclosed in Japanese Patent Application No. 2013-45809, and also has the same function as the lead portion 511 of the multilayer coil 500. The linear conductor 32*a* of the multilayer coil 1 is provided on one insulating layer 22*b*, whereas the linear conductor 501 and the lead portion 511 of the multilayer coil 500 are provided on different insulating layers. Thus, in the multilayer coil 1, the conductor provided on one insulating layer achieves the same functions of the conductors provided on two insulating layers in the multilayer coil 500. Therefore, in a case in which the coil of the multilayer coil 1 and the coil of the multilayer coil 500 have the same number of turns, the number of insulating layers required in the multilayer coil 1 is smaller than the number of insulating layers required in the multilayer coil 500. As is the case with the linear conductor 32*a*, the linear conductor 32*e* has the same functions as the linear conductor 501 and the lead portion 511 of the multilayer coil 500, thereby contributing to a reduction in the number of insulating layers in the multilayer coil 1.

Figure 4:
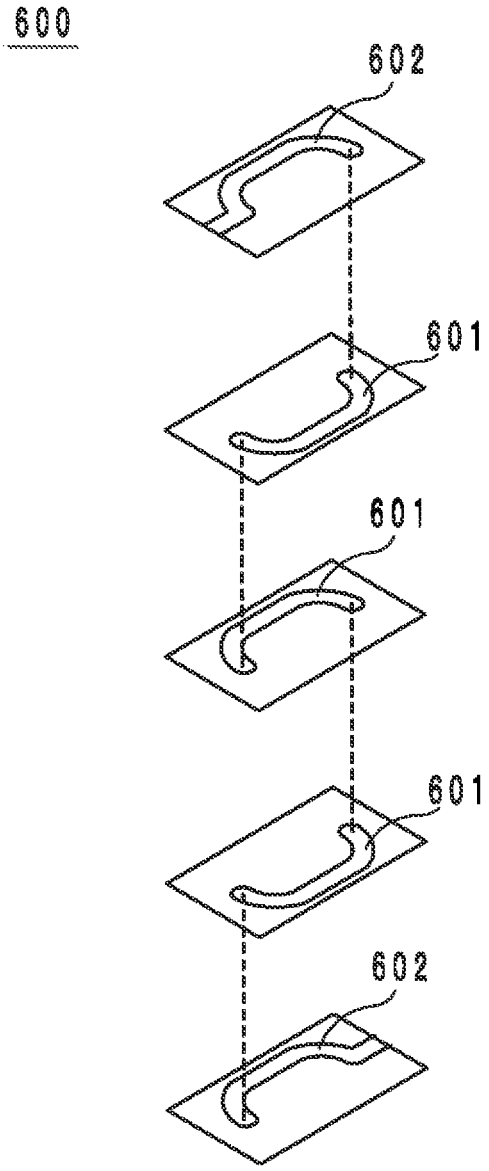
FIG. 4 is an exploded perspective view of a multilayer coil according to a comparative example.
Figure 5:
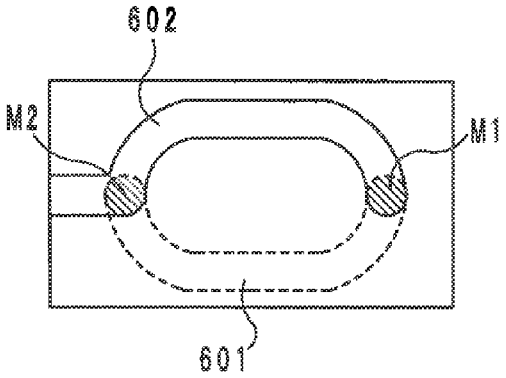
FIG. 5 is a plan view of the multilayer coil according to the comparative example from a layer stacking direction.

In the multilayer coil 1, the lead portion 38*a* is outside the looped track when viewed from the z-direction, and therefore, as seen in FIG. 3, with regard to the linear conductor 32*b* adjacent to the linear conductor 32*a* with one insulating layer in-between, the end thereof on the negative side in the x-direction does not overlap the linear conductor 32*a* when viewed from the layer stacking direction. Thereby, it is possible to reduce the floating capacitance generated between the linear conductor 32*a* and the linear conductor 32*b*. With regard to the linear conductor 32*d* and the linear conductor 32*e* also, the floating capacitance generated therebetween can be reduced for the same reason. Now, as a comparative example with the multilayer coil 1, a multilayer coil 600 that is a modification of the multilayer coil 500 is described. The multilayer 600 comprises a multilayer body formed of a plurality of insulating layers, and as illustrated in FIG. 4, linear conductors 601 and linear conductors 602 are provided on the insulating layers respectively. The linear conductors 601 have the same shape as the linear conductors 501 of the multilayer coil 500. The linear conductors 602 each include a portion having the same shape as the linear conductor 501 and a portion having the same shape as the lead portion 511. In the multilayer coil 600, as seen in FIG. 5, with regard to the linear conductor 601 and the linear conductor 602 adjacent to each other with one insulating layer in-between, when viewed from the layer stacking direction, there is an overlap portion M2 as well as a portion M1 where the linear conductor 601 and 602 are connected by a via conductor. Accordingly, in the multilayer coil 600, floating capacitance is generated in the overlap portion M2. On the other hand, in the multilayer coil 1, with regard to the linear conductor 32*b* adjacent to the linear conductor 32*a* with one insulating layer in-between, as seen in FIG. 3, the end thereof on the negative side in the x-direction does not overlap the linear conductor 32*a*. Therefore, the multilayer coil 1 can reduce the generation of floating capacitance as compared to the multilayer coil 600. Hence, the multilayer coil 1 has a better Q characteristic as compared to the multilayer coil 500 that is of the same kind as the multilayer coil disclosed in Japanese Patent Application No. 2013-45809.

Further, in the multilayer coil 1, the lead portions 38*a* and 38*e*, which correspond to the lead portions 511 of the multilayer coil 500, curve along the winding direction of the coil 30 when viewed from the layer stacking direction. Specifically, the lead portions 38*a* and 38*e* go outward from the looped track gradually while curving along the winding direction of the coil 30. Therefore, the lead portions 38*a* and 38*e* serve as a part of the coil 30. On the other hand, the lead portion 511 of the multilayer coil 500 is straight and does not serve as a part of the coil. For this reason, the multilayer coil 1 has a still better Q characteristic than the multilayer coil 500.

Figure 6:
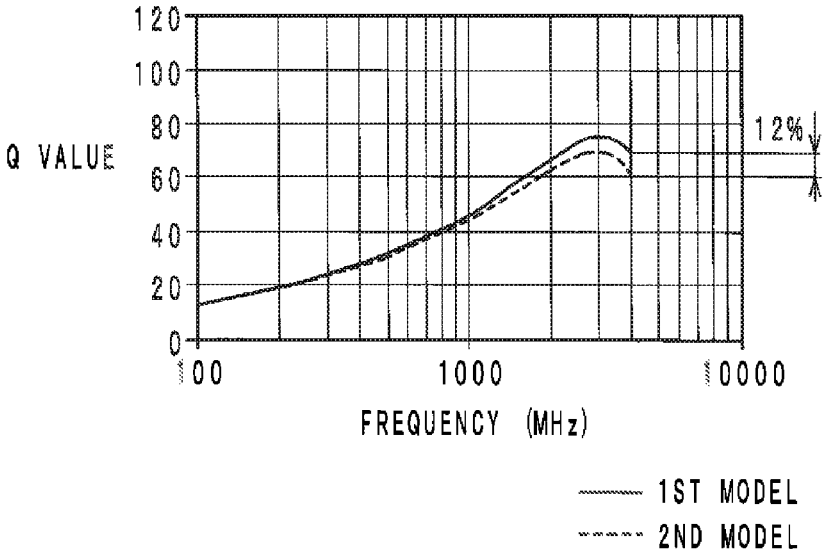
FIG. 6 is a graph indicating results of experiments conducted by use of a first model and a second model.

In order to confirm the effect of the multilayer coil 1, the inventors conducted a simulation to measure Q values. Specifically, the multilayer coil 1 was used as a first model, and a multilayer coil corresponding to the multilayer coil 500 was used as a second model. The inventors simulated situations in which alternating currents are applied to the first model and the second model. The Q value of each of the models was measured while the frequency of the alternating current was varied. FIG. 6 shows results of the simulation conducted on the first model and the second model. In FIG. 6, the y-axis indicates Q value, and the x-axis indicates the frequency (MHz). The size of each model was 1.0 mm×0.6 mm×0.5 mm.

As a result of the simulation, the Q value of the first model was higher than the Q value of the second model. When the frequency was 4 GHz, the Q value of the first model was higher than the Q value of the second model by about 12%. This shows that the multilayer coil 1 has a better Q characteristic than the multilayer coil 500 of the same kind as the multilayer coil disclosed in Japanese Patent Application No. 2013-45809.

In order to achieve an excellent Q characteristic, in the multilayer coil 1, as seen in FIG. 2, the linear conductors 32*a*-32*e* are near the respective center portions of the long sides (parts of the outer edge on the positive and the negative sides in the y-direction) of the insulating layers 22*b*-22*f*. In such a case, if the linear conductors 32*b*-32*d* are designed such that the straight lines passing the respective both ends thereof connected to the via-conductors 34*a*-34*d* cross the long sides of the insulating layers 22*c*-22*e* respectively when viewed from the layer stacking direction, the via conductors 34*a*-34*d* may be exposed on the surface of the multilayer body 20 through the long sides of the insulating layers 22*c*-22*e* due to manufacturing errors (positioning errors in forming vias, errors in cutting the mother multilayer body, etc.) and other factors. In the multilayer coil 1, however, the linear conductors 32*b*-32*d* are designed such that the lines L1-L3 passing the respective both ends thereof connected to the via conductors 34*a*-34*d* cross the short sides SL1-SL6 of the insulating layers 22*c*-22*e* respectively when viewed from the layer stacking direction. By positioning the contact portions between the linear conductors 32*b*-32*d* and the via conductors 34*a*-34*d* to meet this condition, the contact portions between the linear conductors 32*b*-32*d* and the via conductors 34*a*-34*d* are prevented from getting out of the long sides (sides on the positive and the negative sides in the y-direction) of the insulating layers 22*c*-22*e*, that is, prevented from getting outside the respective outer edges of the insulating layers 22*c*-22*e*. Consequently, the via conductors 34*a*-34*d* are prevented from being exposed on the surface of the multilayer body 20.

First Modification; See FIGS. 7 and 8

A multilayer coil 1A according to a first modification differs from the multilayer coil 1 in the shape of the lead portion 38*a* of the linear conductor 32*a* and in the shape of the lead portion 38*e* of the linear conductor 32*e*.

Figure 7:
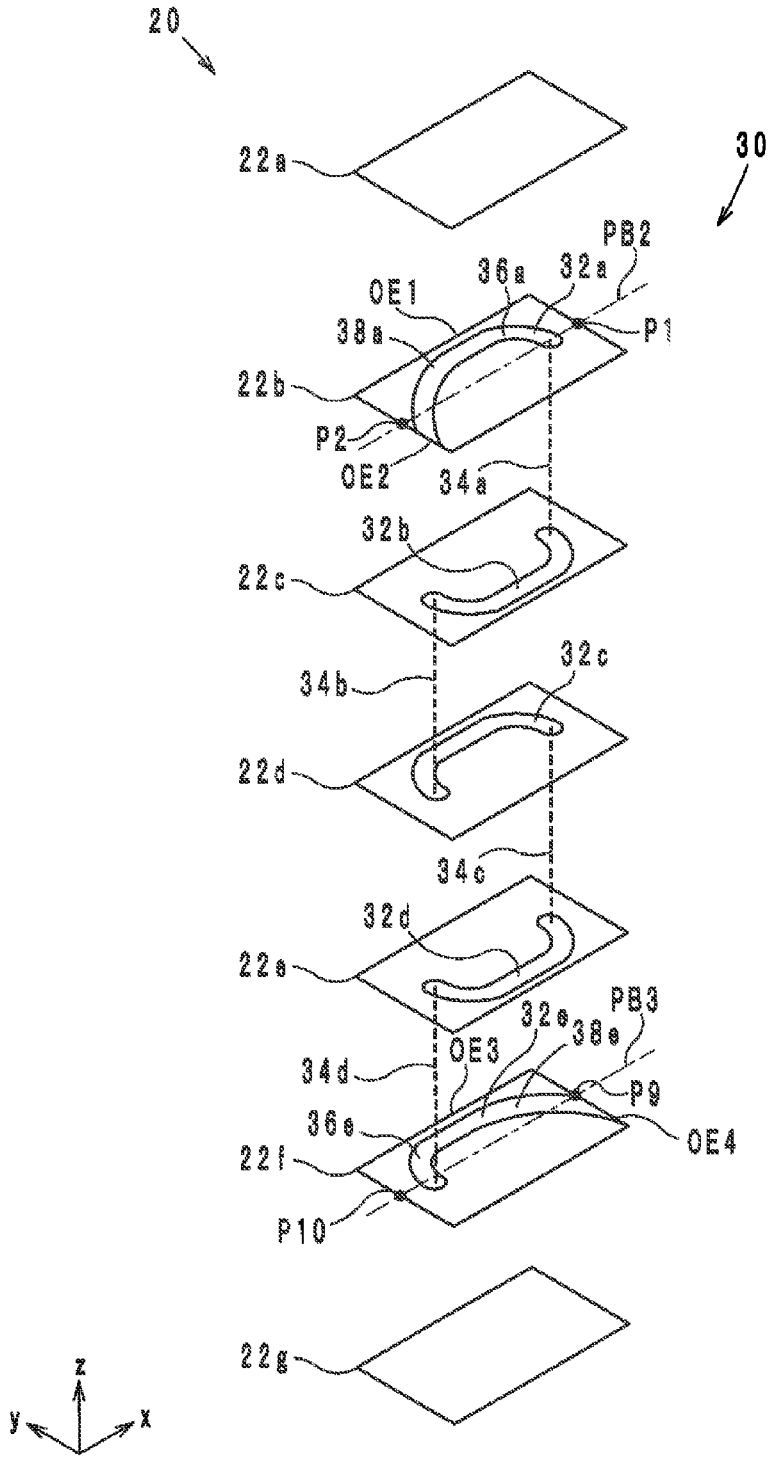
FIG. 7 is a perspective view of a multilayer coil according to a first modification.

In the multilayer coil 1A, as seen in FIG. 7, the lead portion 38*a* extends across the perpendicular bisector of the part of the outer edge OE2 (short side) of the insulating layer 22*b*. Then, the lead portion 38*a* is led out from the portion of the insulating layer 22*b* on the negative side in the y-direction to be exposed on the surface of the multilayer body 20. Accordingly, in the multilayer coil 1A, the lead portion 38*a* runs around as if grazing the outer side of the end of the linear conductor 32*b* connected to the via conductor 32*b*, as compared to the lead portion 38*a* of the multilayer coil 1. Accordingly, in the multilayer coil 1A, the part of the lead portion 38*a* running around the end of the linear conductor 32*b* functions as a part of the coil 30, thereby improving the Q characteristic. The lead portion 38*e* of the multilayer coil 1A also contributes to an improvement in the Q characteristic for the same reason.

In the multilayer coil 1A having the structure above, the lead portions 38*a* and 38*e* have a better performance as a coil, as compared to the lead portions 38*a* and 38*e* of the multilayer coil 1. Therefore, the multilayer coil 1A has a better Q characteristic than the multilayer coil 1. There are no other differences between the multilayer coil 1 and the multilayer coil 1A. Therefore, the description of the multilayer coil 1 is applied to the multilayer coil 1A as well, except for the lead portions 38*a* and 38*e*.

In order to confirm the effect of the multilayer coil 1A, the inventors conducted a simulation to measure Q values.

Figure 8:
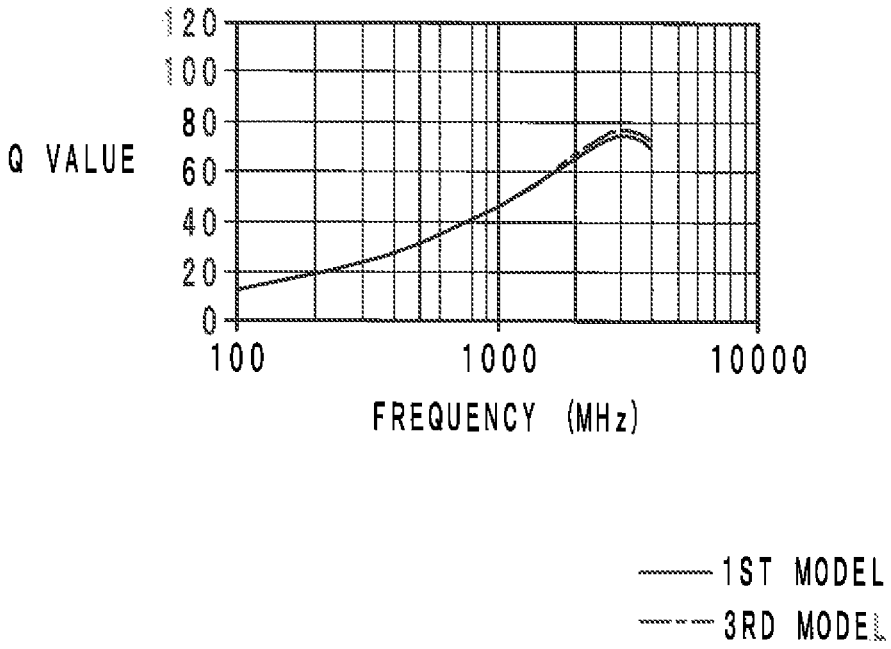
FIG. 8 is a graph indicating results of experiments conducted by use of the first model and a third model.

Specifically, the inventors simulated situations in which alternating currents are applied to the first model corresponding to the multilayer coil 1 and a third model corresponding to the multilayer coil 1A. The Q value of each of the models was measured while the frequency of the alternating current was varied. FIG. 8 shows results of the simulation conducted on the first model and the third model. In FIG. 8, the y-axis indicates Q value, and the x-axis indicates the frequency (MHz). The size of each model was 1.0 mm×0.6 mm×0.5 mm.

As a result of the simulation, the Q value of the third model was higher than the Q value of the first model. This shows that the multilayer coil 1A has a better Q characteristic than the multilayer coil 1.

Second Modification; See FIGS. 9-12

A multilayer coil 1B according to a second modification differs from the multilayer coil 1 in that additional linear conductors having the same shapes as the linear conductors 32*a*-32*e* respectively are provided so as to overlap the corresponding linear conductors 32*a*-32*e* respectively when viewed from the layer stacking direction and in that the additional conductors are connected in parallel to the corresponding linear conductors 32*a*-32*e* respectively.

Figure 9:
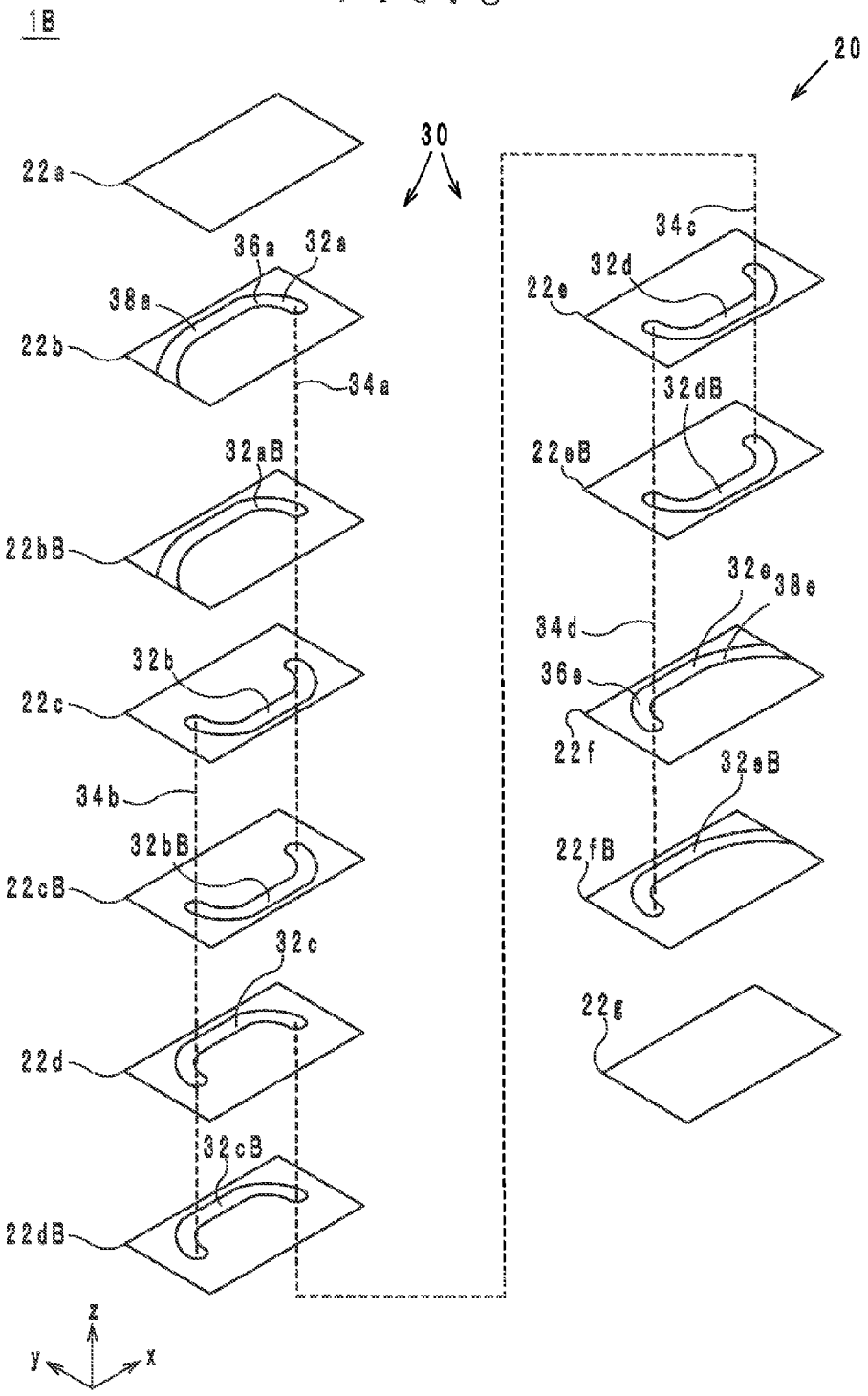
FIG. 9 is an exploded perspective view of a multilayer coil according to a second modification.
Figure 10:
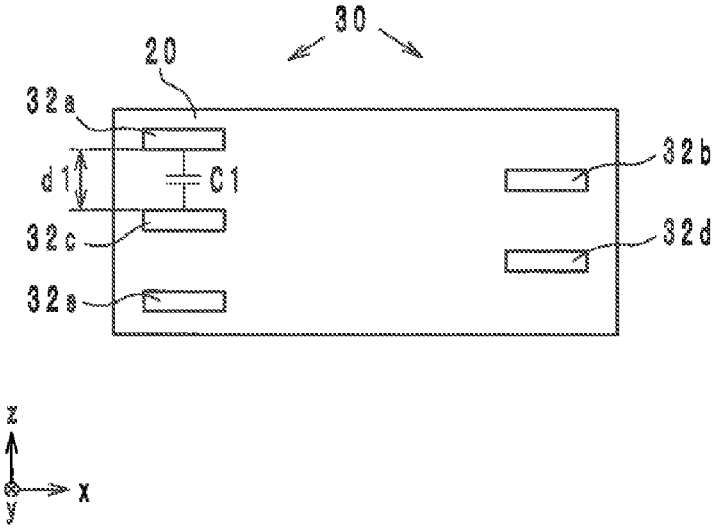
FIG. 10 is a sectional view of the multilayer coil according to the embodiment cut along the line 10-10 in FIG. 1.

In the multilayer coil 1B, as seen in FIG. 9, an insulating layer 22*b*B is provided between the insulating layers 22*b* and 22*c*. On the upper surface of the insulating layer 22*b*B, a linear conductor 32*a*B having the same shape as the linear conductor 32*a* is provided so as to overlap the linear conductor 32*a* when viewed from the layer stacking direction. The linear conductor 32*a* and the linear conductor 32*a*B are connected to the external electrode 40*b* and the via conductor 34*a*. Accordingly, the linear conductor 32*a*B is connected in parallel to the linear conductor 32*a*.

An insulating layer 22*c*B is provided between the insulating layers 22*c* and 22*d*. On the upper surface of the insulating layer 22*c*B, a linear conductor 32*b*B having the same shape as the linear conductor 32*b* is provided so as to overlap the linear conductor 32*b* when viewed from the layer stacking direction. The linear conductor 32*b* and the linear conductor 32*b*B are connected to the via conductor 34*a* and the via conductor 34*b*. Accordingly, the linear conductor 32*b*B is connected in parallel to the linear conductor 32*b*.

An insulating layer 22*d*B is provided between the insulating layers 22*d* and 22*e*. On the upper surface of the insulating layer 22*d*B, a linear conductor 32*c*B having the same shape as the linear conductor 32*c* is provided so as to overlap the linear conductor 32*c* when viewed from the layer stacking direction. The linear conductor 32*c* and the linear conductor 32*c*B are connected to the via conductor 34*b* and the via conductor 34*c*. Accordingly, the linear conductor 32*c*B is connected in parallel to the linear conductor 32*c*.

An insulating layer 22*e*B is provided between the insulating layers 22*e* and 22*f*. On the upper surface of the insulating layer 22*e*B, a linear conductor 32*d*B having the same shape as the linear conductor 32*d* is provided so as to overlap the linear conductor 32*d* when viewed from the layer stacking direction. The linear conductor 32*d* and the linear conductor 32*d*B are connected to the via conductor 34*c* and the via conductor 34*d*. Accordingly, the linear conductor 32*d*B is connected in parallel to the linear conductor 32*d*.

An insulating layer 22*f*B is provided between the insulating layers 22*f* and 22*g*. On the upper surface of the insulating layer 22*f*B, a linear conductor 32*e*B having the same shape as the linear conductor 32*e* is provided so as to overlap the linear conductor 32*e* when viewed from the layer stacking direction. The linear conductor 32*e* and the linear conductor 32*e*B are connected to the via conductor 34*d* and the external electrode 40*a*. Accordingly, the linear conductor 32*e*B is connected in parallel to the linear conductor 32*e*.

The multilayer coil 1B having the structure above is what is called a multilayer bifilar coil, and has an excellent Q characteristic for the following reason.

In a multilayer coil, floating capacitance is generated mainly in portions where linear and other conductors overlap each other when viewed from the layer stacking direction. The shorter the distance between the overlapping conductors is, the greater the floating capacitance generated between the conductors is.

In order to reduce the generation of floating capacitance, in the multilayer coil 1, the linear conductor 32*b* adjacent to the linear conductor 32*a* with one insulating layer in-between is arranged such that the end thereof on the negative side in the y-direction does not overlap the linear conductor 32*a* when viewed from the layer stacking direction. In the multilayer coil 1, however, between linear conductors overlapping each other when viewed in the layer stacking direction, for example, between the linear conductor 32*a* and the linear conductor 32*c*, floating capacitance C1 occurs (see FIG. 10). Now, the distance in the z-direction between the linear conductor 32*a* and the linear conductor 32*c* is defined as a distance d1.

Figure 11:
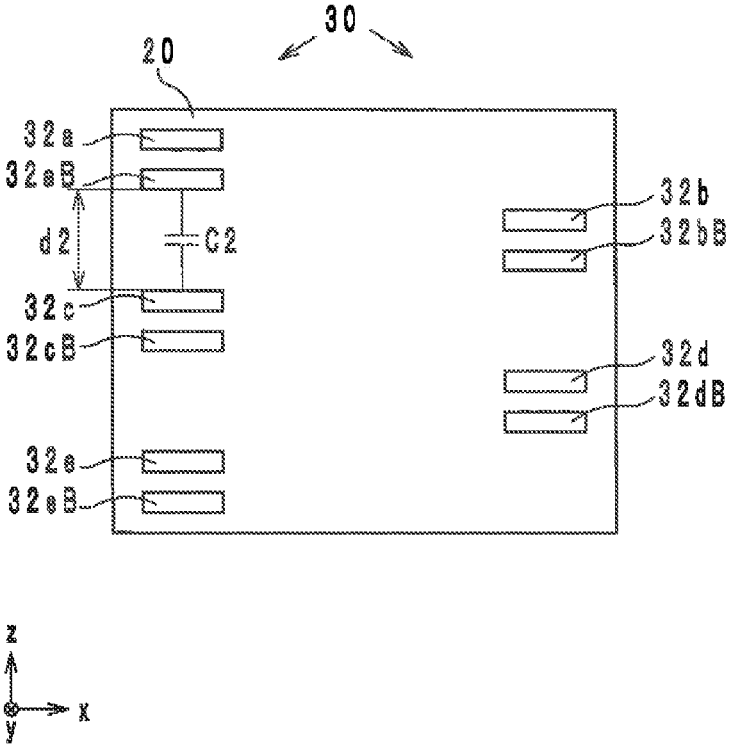
FIG. 11 is a sectional view of the multilayer coil according to the second modification cut along the line 10-10 in FIG. 1.

In the multilayer coil 1B, which is a multilayer bifilar coil, as seen in FIG. 11, the distance d2 between linear conductors overlapping each other when viewed in the layer stacking direction, for example, between the linear conductor 32*a*B and the linear conductor 32*c*, is greater than the distance d1 in the multilayer coil 1. Consequently, the floating capacitance C2 generated between the linear conductor 32*a*B and the linear conductor 32*c* is smaller than the floating capacitance C1 generated in the multilayer coil 1.

Thus, in the multilayer coil 1B, the generation of floating capacitance between adjacent linear conductors with an insulating layer in-between is reduced, and further, the generation of floating capacitance between linear conductors overlapping each other when viewed from the layer stacking direction is reduced. In such a multi-filar coil, the greater the number of conductors connected in parallel to each other is, the greater the distance between linear conductors overlapping each other when viewed from the layer stacking direction is, and accordingly, the more noticeable the effect is.

In order to confirm the effect of the multilayer coil 1B, the inventors conducted a simulation.

Figure 12:
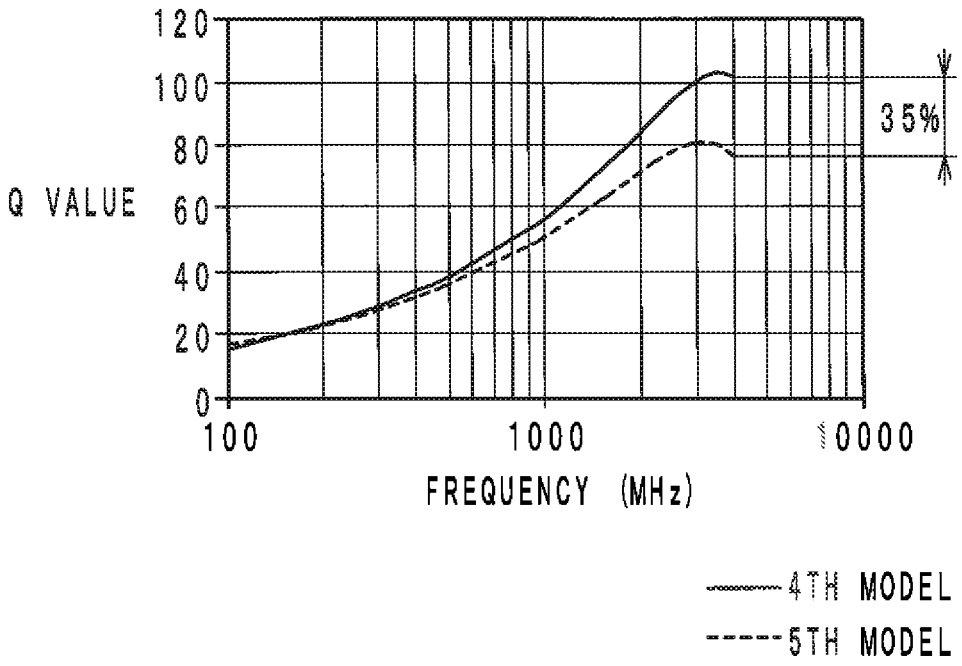
FIG. 12 is a graph indicating results of experiments conducted by use of a fourth model and a fifth model.

Specifically, the inventors simulated situations in which alternating currents are applied to a fourth model corresponding to the multilayer coil 1B and a fifth model that is a bifilar-type modification of the multilayer coil 500. The Q value of each of the models was measured while the frequency of the alternating current was varied. FIG. 12 shows results of the simulation conducted on the fourth model and the fifth model. In FIG. 12, the y-axis indicates Q value, and the x-axis indicates the frequency (MHz). The size of each model was 1.0 mm×0.6 mm×0.5 mm.

As a result of the simulation, the Q value of the fourth model was higher than the Q value of the fifth model by about 35%. This shows that the multilayer coil 1B has a better Q characteristic than the bifilar-type modification of the multilayer coil 500.

In this modification, the linear conductors 32*a*-32*e* are connected in parallel respectively to the linear conductors 32*a*B-32*e*B having the same shapes as the linear conductors 32*a*-32*e* respectively. However, in order to obtain the effect to reduce the floating capacitance, it is only necessary that either of the linear conductors 32*a*-32*e* is connected in parallel to either of the linear conductors 32*a*B-32*e*B having the same shape as the linear conductor. In other words, it is not necessary that all of the linear conductors 32*a*-32*e* are connected in parallel to the linear conductors 32*a*B-32*e*B respectively so as to obtain the effect to reduce the floating capacitance. In sum, what is needed is that there is at least one pair of linear conductors connected in parallel. There are no other differences between the multilayer coil 1 and the multilayer coil 1C. Therefore, the description of the multilayer coil 1 is applied to the multilayer coil 1B as well, except for the point that linear conductors having the same shape as the linear conductors 32*a*-32*e* are connected in parallel respectively to the corresponding linear conductors 32*a*-32*e*.

Third Modification; See FIG. 13

A multilayer coil 1C according to a third modification differs from the multilayer coil 1 in the number of insulating layers and in the arrangement of the insulating layers.

Figure 13:
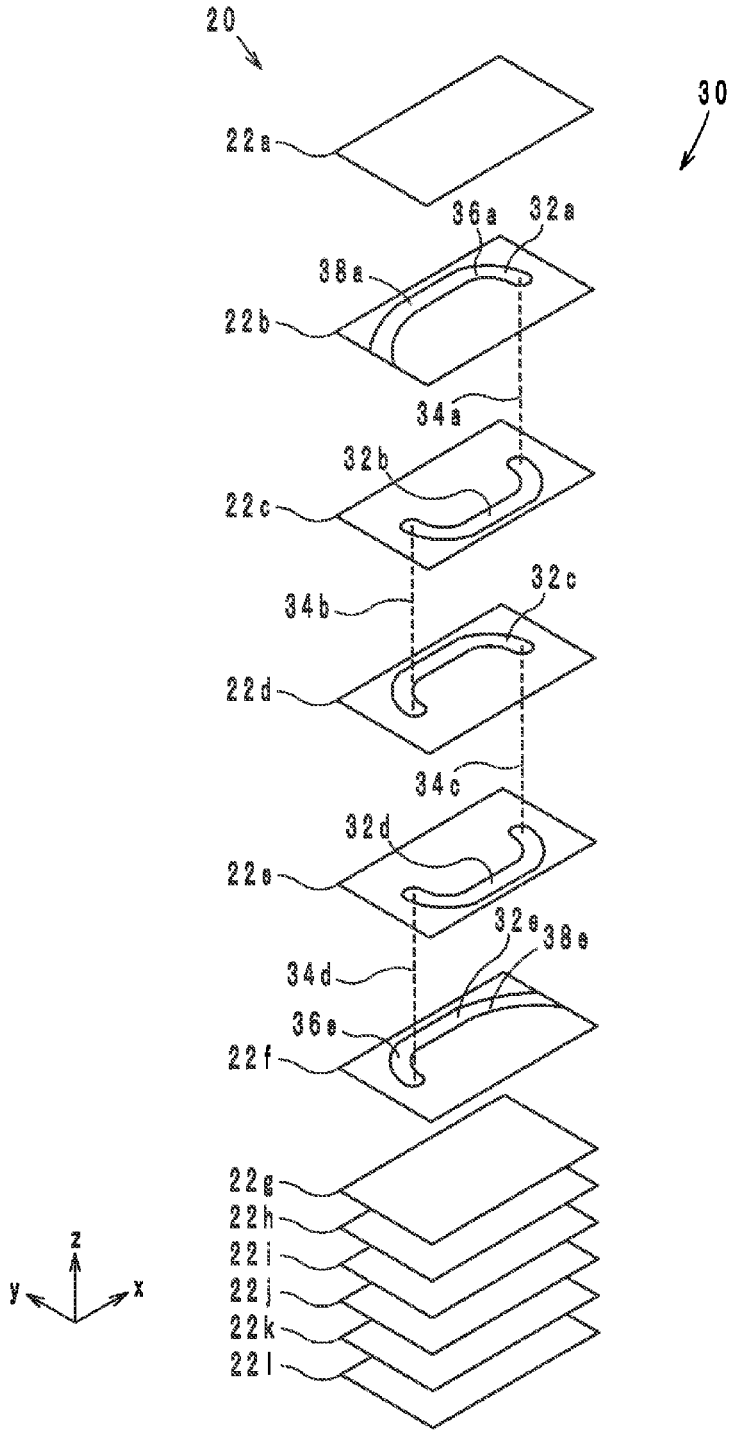
FIG. 13 is an exploded perspective view of a multilayer coil according to a third modification.

As illustrated in FIG. 13, in the multilayer coil 1C, insulating layers 22*h*-221 are additionally provided on the negative side in the z-direction of the insulating layer 22*g*. Accordingly, in the multilayer coil 1C, the coil 30 is located off-center in the multilayer body 20, specifically, in the portion of the multilayer body 20 on the positive side in the z-direction (in the upper portion of the multilayer body 20). The surface of the multilayer coil 1C on the negative side in the z-direction (the bottom surface of the multilayer body 20) is a mounting surface to face a printed wiring board on which the multilayer coil 1C is to be mounted. Therefore, in the multilayer coil 1C, the coil 30 is far from the mounting surface as compared to the multilayer coil 1. Accordingly, the multilayer coil 1C can reduce the interlinkage between magnetic fluxes generated by the coil 30 and a conductive pattern on the printed wiring board. Consequently, the multilayer coil 1C has a better Q characteristic than the multilayer coil 1. There are no other differences between the multilayer coil 1 and the multilayer coil 1C. Therefore, the description of the multilayer coil 1 is applied to the multilayer coil 1C as well, except for the number and the arrangement of insulating layers.

Fourth Modification; See FIG. 14

A multilayer coil 1D according to a fourth modification differs from the multilayer coil 1 in the configuration of the coil 30 and in the configuration of the multilayer body 20.

Figure 14:
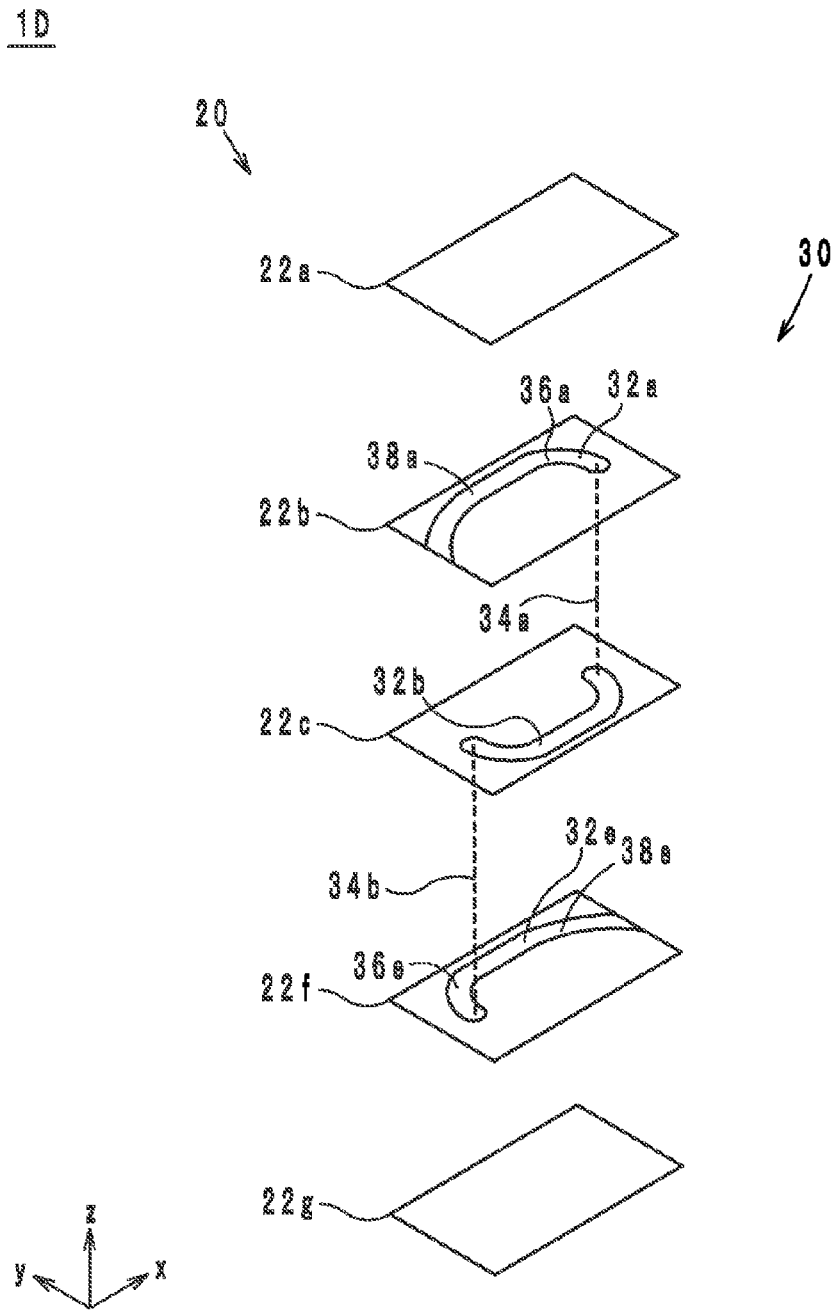
FIG. 14 is an exploded perspective view of a multilayer coil according to a fourth modification.

As illustrated in FIG. 14, the coil 30 of the multilayer coil 1D is formed of the linear conductors 32*a*, 32*b* and 32*e*, and the via conductors 34*a* and 34*b*. The insulating layers 22*d* and 22*e* are not provided in the multilayer coil 1D. Accordingly, the multilayer body 20 is formed of the insulating layers 22*a*-22*c*, 22*f* and 22*g*. There are no other differences between the multilayer coil 1 and the multilayer coil 1D. Therefore, the description of the multilayer coil 1 is applied to the multilayer coil 1D as well, except for the configuration of the coil 30 and the number of insulating layers.

In the multilayer coil 1D having the structure above, the lead portion 38*a* is outside the looped track when viewed from the z-direction. Therefore, with regard to the linear conductor 32*b* adjacent to the linear conductor 32*a* with one insulating layer in-between, the end thereof on the negative side in the x-direction does not overlap the linear conductor 32*a* when viewed from the layer stacking direction. Accordingly, the floating capacitance generated between the linear conductor 32*a* and the linear conductor 32*b* can be reduced. Also, the floating capacitance generated between the linear conductor 32*e* and the linear conductor 32*b* can be reduced for the same reason. Consequently, the multilayer coil 1D has an excellent Q value as is the case with the multilayer coil 1.

Fifth Modification; See FIGS. 15 and 16

A multilayer coil 1E according to a fifth modification differs from the multilayer coil 1 in the relative position of the coil 30 to the multilayer body 20, the shape of the lead portion 38*a* of the linear conductor 32*a* and the shape of the lead portion 38*e* of the linear conductor 32*e*.

Figure 15:
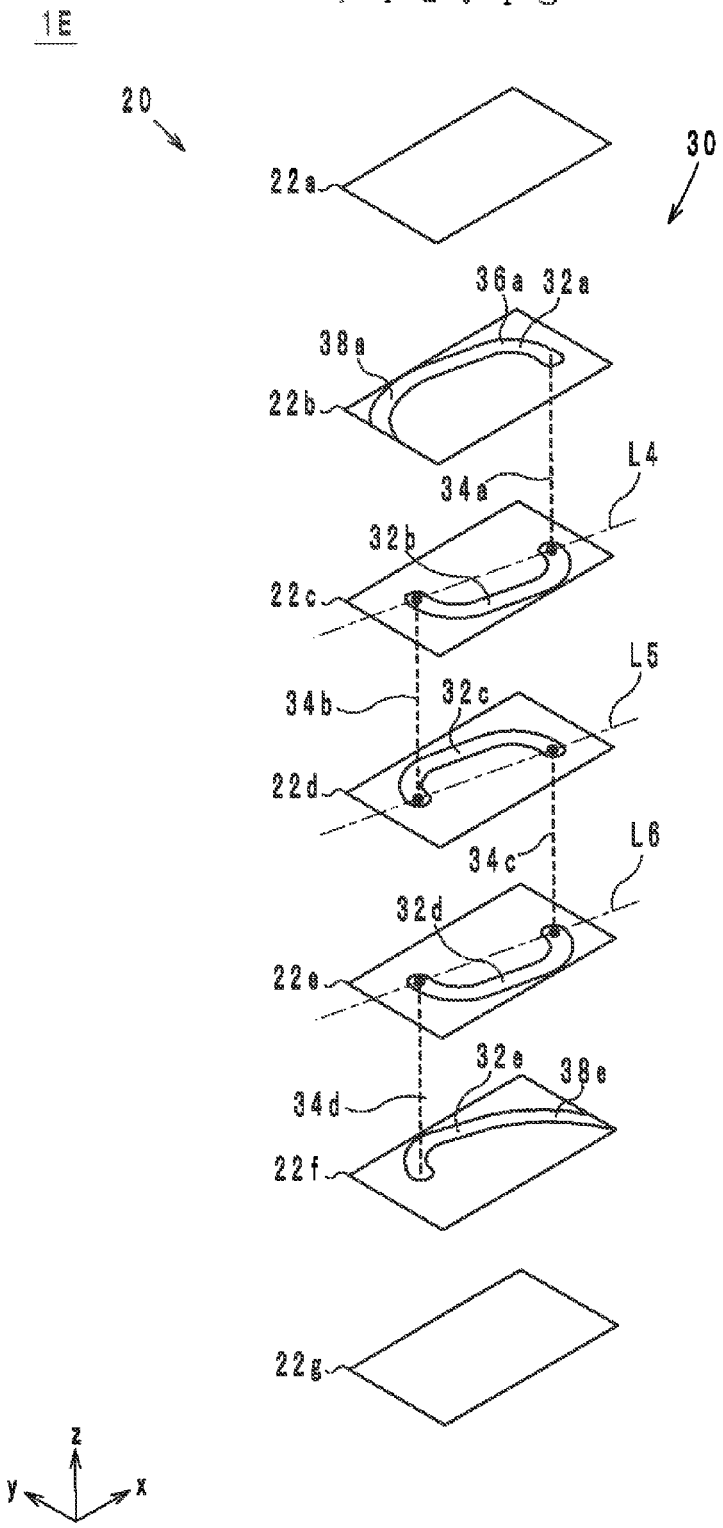
FIG. 15 is an exploded perspective view of a multilayer coil according to a fifth modification.
Figure 16:
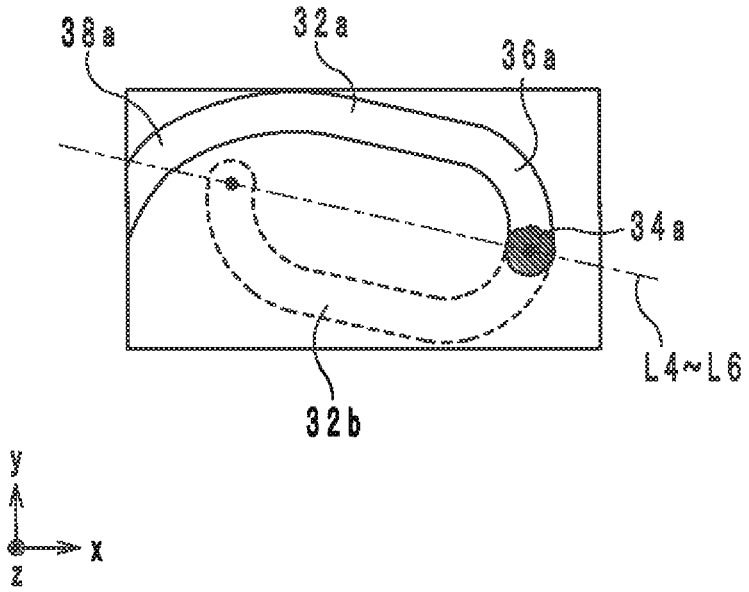
FIG. 16 is a plan view of the multilayer coil according to the fifth modification from a layer stacking direction.
Figure 17:
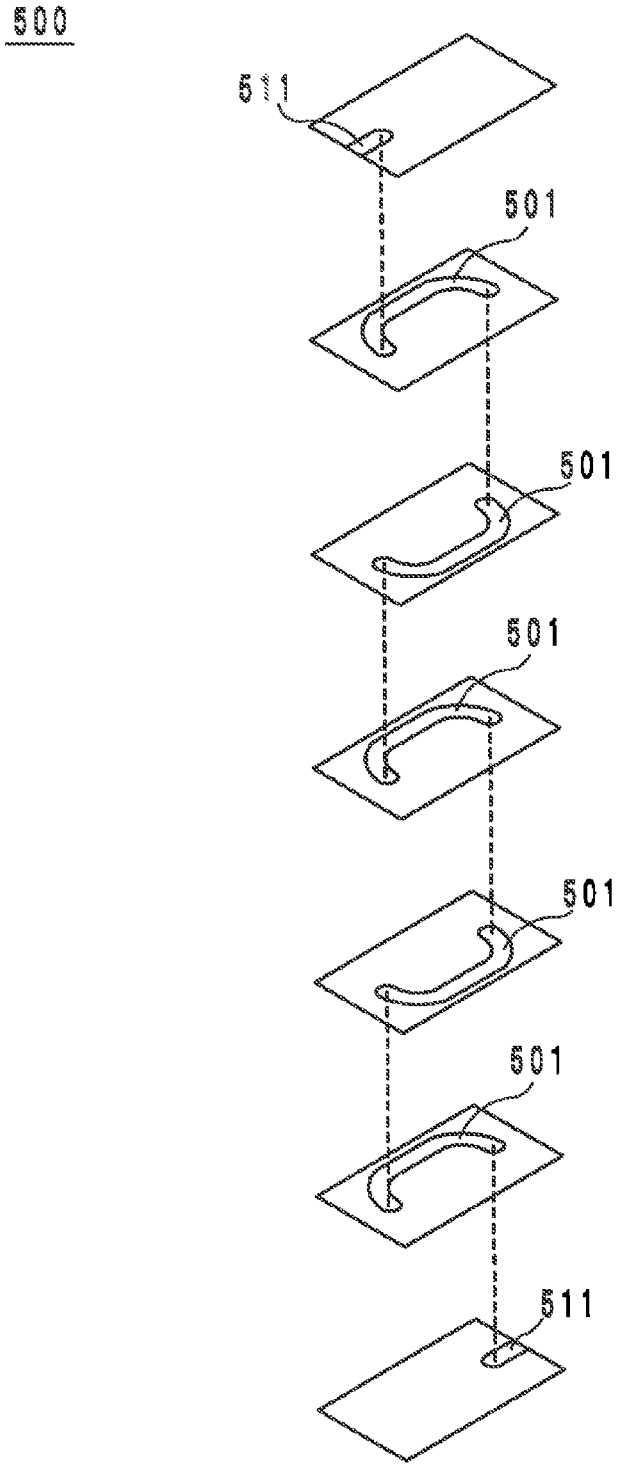
FIG. 17 PRIOR ART
FIG. 17 is an exploded perspective view of a multilayer coil of the same kind as the multilayer coil disclosed in Japanese Patent Application No. 2013-45809.

As seen in FIGS. 15 and 16, in the multilayer coil 1E, the coil 30 is substantially in the shape of an ellipse when viewed from the z-direction. Straight lines L4-L6 passing the respective both ends of the linear conductors 32*b*-32*d* are on the long axis of the ellipse. The lines L4-L6 slant from the x-direction. In sum, the coil 30 of the multilayer coil 1E slants from the coil 30 of the multilayer coil 1. Accordingly, the relative position of the coil 30 to the multilayer body 20 in the multilayer coil 1E is different from the relative position of the coil 30 to the multilayer body 20 in the multilayer coil 1.

In the multilayer coil 1E, as seen in FIG. 16, the lead portion 38*a* extends across the line L4 when viewed from the z-direction and is led from the portion on the negative side in the y-direction to be exposed on the surface of the multilayer body 20. Accordingly, the lead portion 38*a* of the multilayer coil 1E runs around as if grazing the outer side of the end of the linear conductor 32*b* connected to the via conductor 34*b*, as compared to the lead portion 38*a* in the multilayer coil 1. Consequently, in the multilayer coil 1E, the part of the lead conductor 38*a* running around the end of the linear conductor 32*b* functions as a part of the coil 30, and the Q characteristic is improved. The lead portion 38*e* of the multilayer coil 1E also contributes to an improvement in the Q characteristic for the same reason.

In the multilayer coil 1E having the structure above, the lead portions 38*a* and 38*e* have a better performance as a coil as compared to the lead portions 38*a* and 38*e* of the multilayer coil 1. Therefore, the multilayer coil 1E has a better Q characteristic than the multilayer coil 1.

In the multilayer coil 1E, the lines L4-L6 passing the respective both ends of the linear conductors 32*b*-32*d*, that is, the lines passing the respective contact portions of the linear conductors 32*b*-32*d* with the via conductors slant from the x-direction. Accordingly, the via conductors can be positioned away from the long sides or the short sides of the insulating layers forming the outer edge of the multilayer body. Therefore, it is possible to design the positions of the via conductors more flexibly, and it is possible to prevent the exposure of the via conductors 34*a*-34*d* on the surface of the multilayer body 20 through the long sides or the short sides of the insulating layers 22*c*-22*e* due to manufacturing errors (positioning errors in forming vias, errors in cutting the mother multilayer body, etc.) and other factors. There are no other differences between the multilayer coil 1 and the multilayer coil 1E. Therefore, the description of the multilayer coil 1 is applied to the multilayer coil 1E as well, except for the relative positions of the coil 30 to the multilayer body 20, the shape of the lead portion 38*a* of the linear conductor 32*a* and the shape of the lead portion 38*e* of the linear conductor 32*e*.

Other Embodiments

Multilayer coils according to the present disclosure are not limited to the above-described embodiment and modifications, and various modifications and changes are possible within the scope of the disclosure. For example, the linear conductors 32*b*-32*d* may be angulated so as to extend along the respective outer edges of the insulating layers 22*c*-22*e*, that is, the linear conductors 32*b*-32*d* may be rectangular U-shaped when viewed from the layer stacking direction. In sum, the linear conductors 32*b*-32*d* are only required to make such a loop merely as to function as a coil. The same applies to the linear conductors 32*a* and 32*e* as well. The multilayer coil may be a multi-filar coil in which the number of conductors connected in parallel to each other is not exclusively two and may be three or more.

The lead portion 38*a* may extend straight from the coil portion 36*a* in parallel to the x-direction toward the edge OE2. Likewise, the lead portion 38*e* may extend straight from the coil portion 36*e* in parallel to the x-direction toward the edge OE4. In this case, the lead portions 38*a* and 38*e* get away from the looped track of the lead conductors 32*b*-32*d*. Consequently, the capacitance between the lead portion 38*a* and the linear conductor 32*c* is reduced, and the capacitance between the lead portion 38*e* and the linear conductor 32*c* is reduced.

The coil portion 36*a* of the linear conductor 32*a* (first linear conductor) and the coil portion 36*e* of the linear conductor 32*e* (third linear conductor) do not need to be in the shape of a quarter of a circle. The coil portions 36*a* and 36*e* may be arcs longer than or shorter than a quarter of a circle. Also, the arcs of the coil portions 36*a* and 36*e* may have different lengths.

INDUSTRIAL APPLICABILITY

As thus far described, the present disclosure is useful for multilayer coils. Especially, the present disclosure has an advantageous effect to permit a multilayer coil including a linear conductor having a length corresponding to a half turn of a loop when viewed from a layer stacking direction to have an excellent Q characteristic.

What is claimed is:

1. A multilayer coil comprising:

a multilayer body including a plurality of insulating layers stacked on one another;

a coil provided at the multilayer body and including a plurality of linear conductors connected together by a plurality of via conductors piercing through the insulating layers; and a first external electrode provided on a surface of the multilayer body, wherein:

the coil makes a looped track when viewed from a layer stacking direction in which the plurality of insulating layers are stacked;

the plurality of linear conductors includes a first linear conductor contacting with the first external electrode, and a second linear conductor forming a part of the looped track when viewed from the layer stacking direction and having a length corresponding to a half turn of the looped track;

at least a part of the first linear conductor is a coil portion forming a part of the looped track when viewed from the layer stacking direction;

the second linear conductor is adjacent to the first linear conductor with at least one of the insulating layers in-between, and a first end of the second linear conductor is connected to a first end of the first linear conductor by a first via conductor of the plurality of via conductors;

a second end of the second linear conductor adjacent to the first linear conductor with the at least one insulating layer in-between does not overlap the first linear conductor when viewed from the layer stacking direction;

the first linear conductor includes a lead portion connecting the coil portion and the first external electrode;

when viewed from the layer stacking direction, a straight line passing through the first end and the second end of the second linear conductor crosses obliquely the lead portion; and when viewed from the layer stacking direction, the lead portion contacts with a periphery of the insulating layer at one side of the straight line passing through the first end and the second end of the second linear conductor.

2. The multilayer coil according to claim 1, wherein, when viewed from the layer stacking direction, the first linear conductor, as a whole, has substantially an arc-like shape extending in a coil winding direction in which the coil winds.

3. The multilayer coil according to claim 1, wherein:

when viewed from the layer stacking direction, a perpendicular bisector of a line segment between the first and the second ends of the second linear conductor is assumed as a border line;

when viewed from the layer stacking direction, the first end of the first linear conductor is located on one side of the border line; and when viewed from the layer stacking direction, a second end of the first linear conductor is led to a part of an outer edge of the insulating layers on an opposite side of the border line from the first end of the first linear conductor.

4. The multilayer coil according to claim 1, wherein:

when viewed from the layer stacking direction, each of the plurality of insulating layers is rectangular;

the second linear conductor contacts with the via conductors at predetermined two points; and when viewed from the layer stacking direction, a straight line passing through the two contact points of the second linear conductor with the via conductors crosses short sides of the insulating layer that are parts of an outer edge of the insulating layer.

5. The multilayer coil according to claim 4, wherein the straight line passing through the two contact points of the second linear conductor with the via conductors is not parallel to long sides of the insulating layer that are parts of the outer edge of the insulating layer.

6. The multilayer coil according to claim 1, wherein:

when viewed from the layer stacking direction, each of the plurality of insulating layers is rectangular; and the lead portion crosses obliquely a perpendicular bisector of a short side of the insulating layer that is a part of an outer edge of the insulating layer.

7. The multilayer coil according to claim 1, wherein at least a part of the plurality of linear conductors includes linear conductors arranged to be adjacent to each other with at least one of the insulating layers in-between so as to overlap each other when viewed from the layer stacking direction, and the linear conductors arranged to be adjacent to each other with the at least one insulating layer in-between so as to overlap each other when viewed from the layer stacking direction are electrically connected in parallel to each other.

8. The multilayer coil according to claim 1, further comprising a second external electrode provided on the surface of multilayer body, wherein:

the plurality of linear conductors further include a third linear conductor contacting the second external electrode;

the second linear conductor is located between the first linear conductor and the third linear conductor, the second linear conductor being adjacent to the first linear conductor with at least one of the insulating layers in-between and being adjacent to the third linear conductor with other one or more of the insulating layers in-between;

the second end of the second linear conductor is connected to the third linear conductor by a second via conductor of the plurality of via conductors; and when viewed from the layer stacking direction, the first end of the second linear conductor does not overlap the third linear conductor.

9. The multilayer coil according to claim 1, wherein:

a bottom surface of the multilayer body is used as a mounting surface to face a printed wiring board on which the multilayer coil is to be mounted; and the coil is located off-center in the multilayer body, in the upper portion of the multilayer body.

* * * * *